US006813362B2

(12) United States Patent
Bank et al.

(10) Patent No.: US 6,813,362 B2
(45) Date of Patent: Nov. 2, 2004

(54) LOUDSPEAKER AND METHOD OF MAKING SAME

(75) Inventors: Andrew D. Bank, Bedford (GB); Ian D. MacFarlane, Irthlingborough (GB); Keith D. Hills, Huntingdon (GB); Paul Burton, Huntingdon (GB); Neil Harris, Cambridge (GB)

(73) Assignee: New Transducers Limited, Cambridgeshire (GB)

( * ) Notice: Subject to any disclaimer, the term of this patent is extended or adjusted under 35 U.S.C. 154(b) by 390 days.

(21) Appl. No.: 10/116,750

(22) Filed: Apr. 5, 2002

(65) Prior Publication Data

US 2002/0172393 A1 Nov. 21, 2002

Related U.S. Application Data

(60) Provisional application No. 60/281,807, filed on Apr. 6, 2001, provisional application No. 60/303,785, filed on Jul. 10, 2001, and provisional application No. 60/331,719, filed on Nov. 21, 2001.

(30) Foreign Application Priority Data

| | | |
|---|---|---|
| Apr. 5, 2001 | (GB) | 0108504 |
| Jul. 3, 2001 | (GB) | 0116305 |
| Nov. 20, 2001 | (GB) | 0127788 |

(51) Int. Cl.[7] ..... H04R 25/00

(52) U.S. Cl. ..... 381/152; 381/423; 381/186

(58) Field of Search ..... 381/152, 337, 381/182, 186, 306, 333, 388, 386, 396, 423, 424, 425, 431, 429, 353, 354; 181/163, 164

(56) References Cited

U.S. PATENT DOCUMENTS

| | | | | |
|---|---|---|---|---|
| 6,031,926 A | * | 2/2000 | Azima et al. | 381/423 |
| 6,201,878 B1 | * | 3/2001 | Azima et al. | 381/386 |

FOREIGN PATENT DOCUMENTS

| | | |
|---|---|---|
| DE | 198 21 862 A1 | 11/1999 |
| WO | WO 97/09845 A2 | 3/1997 |
| WO | WO 00/28781 A1 | 5/2000 |

* cited by examiner

*Primary Examiner*—Huyen Le
(74) *Attorney, Agent, or Firm*—Foley & Lardner LLP

(57) ABSTRACT

A loudspeaker includes an assembly of at least two bending wave panel-form acoustic members each having a set of modes which are distributed in frequency. The parameters of at least two of the acoustic members are selected so that the modal distributions of each acoustic member are substantially different. The arrangement is such that the modal distributions of the assembly of acoustic members are interleaved constructively in frequency. A transducer applies bending wave energy to the acoustic members to cause them to resonate to produce an acoustic output. A method of making such a loudspeaker is also provided.

43 Claims, 14 Drawing Sheets

LOUDSPEAKER AND METHOD OF MAKING SAME

This application claims the benefit of provisional application Nos. 60/281,807, filed Apr. 6, 2001; 60/303,785, filed Jul. 10, 2001 and 60/331,719, filed Nov. 21, 2001.

BACKGROUND

1. Technical Field

The invention relates to loudspeakers, and more particularly to resonant bending wave speakers of the general kind described in U.S. Pat. No. 6,332,029 (incorporated by reference herein in its entirety). This patent describes a new class of speaker known as a distributed mode loudspeaker (DML).

2. Background Art

It is known from International Application WO97/09846 to provide a loudspeaker comprising two separately driven panels. The first panel is small and designed to operate at higher frequencies than the large second panel in which it is suspended. The frequency ranges of each panel may overlap in the mid-range and a cross-over network may be added to control output in any overlapping frequency range.

It is known from International Application WO98/52381 to have a loudspeaker comprising a larger low frequency panel and a smaller higher frequency panel which are both excited by a common driver. The smaller and larger panels may be attached together by a material forming a controlling compliant coupling whereby differentiation of the high and lower frequency parts of the loudspeaker is achieved.

SUMMARY OF THE INVENTION

According to a first aspect of the present invention, there is provided a loudspeaker comprising an assembly of at least two bending wave panel-form acoustic members each having a set of modes which are distributed in frequency, the parameters of at least two of the acoustic members being selected so that the modal distributions of each acoustic member are substantially different and the arrangement being such that the modal distributions of the assembly of acoustic members are interleaved constructively in frequency. The loudspeaker further includes a transducer to apply bending wave energy to the acoustic members to cause them to resonate to produce an acoustic output.

By constructively interleaving the modal distributions of the acoustic members, the overall modal distribution of the loudspeaker is more dense, i.e. has more modes in a given frequency range, than the modal distribution of any individual acoustic member. Thus in contrast to the prior art, the acoustic members are designed to cover substantially overlapping or substantially the same frequency ranges rather than different frequency ranges which may have some overlap in the mid-range (i.e. around 1 to 2 kHz).

In particular the modal distributions may be constructively interleaved whereby the modes in the overall modal distribution of the assembly are more evenly distributed in frequency than the modes of any individual acoustic member. Thus, any "bunching" or clustering of the modes which may be present in an individual acoustic member may be significantly reduced in the overall distribution. The modes in the modal distribution of the assembly may be substantially evenly distributed in frequency. In these ways, the overall output of the loudspeaker may be enhanced and a smoother frequency response may be achieved.

The acoustic members may have different areas and or shapes so that each acoustic member has a different modal distribution as required. Alternatively, different modal distributions may be achieved by using acoustic members which differ in their mechanical parameters, i.e. parameters such as bending stiffness, damping, mass per unit area or Young's modulus etc.

At least two of the acoustic members may be coupled together by a coupling such that bending wave energy is transmissible between the acoustic members. Thus, the acoustic members may be both mechanically and acoustically coupled by the coupling. In this way, a transducer need only be attached to one face and adjacent faces may be driven by bending wave energy which is transmitted across the coupling. Complex interactions between acoustic members in the assembly, both mechanical and acoustic, may thus be encouraged to increase the excitation of the available modes in each member, particularly if some of the acoustic members are not actively excited.

The assembly of acoustic members may comprise a single piece of stiff lightweight sheet material which should greatly simplify manufacture and assembly. Alternatively, the assembly may comprise a plurality of discrete acoustic members made from stiff lightweight sheet material. A stiff material is one which is self-supporting. The coupling may be sufficiently flexible to allow flat-packing of the assembly. The coupling may be continuous or discontinuous.

For an assembly formed from a single sheet, the coupling may be formed by at least one fold or a parallel pair of folds in the sheet material. A double fold may provide extra compliance and more decoupling between faces. Each fold may be formed by grooving the sheet material and the grooving may comprise local compression of the sheet material.

For an assembly made of discrete members, the coupling may comprise coupling members. The coupling members may comprise hinge portions whereby the acoustic members are moveable relative to one another.

The assembly of acoustic members may form a three-dimensional or box-form loudspeaker which defines a volume, may be of any suitable geometrical shape, e.g. tetrahedron and may be open or closed with different orientations of members. The assembly may comprise a front face and side faces and may be arranged to define a rear opening for example between an opposed pair of rear faces. At least one or two of the acoustic members may be substantially triangular. The assembly may form a truncated pyramid and the plane of the truncation may be angled, for example at 20°, with respect to the plane of the base of the pyramid.

Alternatively, the acoustic members may be arranged to lie substantially in the same plane. The acoustic members may be in the form of panels which may be flat or curved in one or more planes. For curved panels, the panels may be arranged on the same surface of a volume of rotation.

Each acoustic member may act as a baffle for an adjacent acoustic member. The baffling effect may be improved by partially or completely filling the volume defined by the assembly, e.g. with foam or other known acoustic treatments.

The transducer may comprise an inertial or grounded vibration transducer which may be a moving coil inertial exciter comprising a magnet assembly and a voice coil assembly, a piezoelectric transducer, a magnetostrictive transducer, a bender or torsional transducer (e.g. of the type taught in U.S. patent application Ser. No. 09/384,419 (filed on Aug. 27, 1999)) or a distributed mode transducer (e.g. of the type taught in U.S. patent application Ser. No. 09/768, 002 (filed on Jan. 24, 2001)) (each of which is incorporated by reference herein in their entirety). Particularly for folding speakers, the transducers are preferably inertial. The transducers may be mounted to the acoustic members for example as taught in U.S. Pat. No. 6,192,136, U.S. patent application Ser. No. 09/341,295 (filed on Jan. 5, 1998) or U.S. patent application Ser. No. 09/437,792 (filed on Nov. 10, 1999) (each of which is incorporated by reference herein in their entirety) The transducers, particularly low frequency transducers, may be designed to have a fundamental suspension resonance below that of the desired low frequency range of the speaker and a filter may be used to prevent bottoming of the transducers below their fundamental resonance.

The transducer may be a moving coil inertial exciter comprising a magnet assembly and a voice coil assembly. If the transducer is mounted on a sloping face, there is uneven weight loading which may lead to unwanted non-axial movement of the magnet assembly. The magnet assembly may thus be supported in a transducer housing mounted to the acoustic member. The housing may be in the form of a plastic spider which decouples the mass of the transducer from the acoustic member. The transducer housing discourages unwanted non-axial movement of the magnet assembly and hence voice coil damage may be alleviated and the transducer excursion may be limited.

The transducers may comprise respective vibration transducers attached to respective acoustic members. By providing transducers on more than one face, stereo sources may be obtained from a single object. A transducer may be mounted to each face of the box-form structure whereby omnidirectivity at high frequencies may be improved.

Different transducers may be used for different frequency ranges and they may be connected by a crossover, e.g. a first order low pass crossover comprising a series inductor. The filter may comprise a first order series capacitor having a value selected to resonate with the series inductor at a frequency where the output of the speaker as a whole is weak, providing a boost over a controlled frequency band. A passive second order high pass filter may be used to protect the transducer by band-limiting the signal, but may also be used to 'ring' the knee of the filter to obtain boost in the bass, helping to compensate for a dipole gradient roll of or other bass level loss. A modified amplifier transfer function may also be used to boost bass levels.

The stiff lightweight sheet material may be corrugated board or the like. The corrugated board may comprise face skins sandwiching a corrugated core. The assembly may have a front face having a base and at least one side face having a base and the corrugated core may be arranged so that in the front face its corrugations extend perpendicular to the base and/or in the side face its corrugations are at an acute angle to its base.

Alternatively, the stiff lightweight sheet material may be vacuum-formed plastics or extruded twin wall polypropylene sheet, e.g. such as that sold under the trade-mark "Correx", the latter being generally equivalent to corrugated cardboard. All such materials permit the manufacture of very lightweight, portable, low cost and possible disposable speakers. Alternatively, more durable, long lasting or higher performance sheet materials could be used, e.g. that sold under the trade mark "Traumalite".

Each loudspeaker may have a base and may define a closed box. The loudspeaker may be suspended above the floor and the base may be a radiating acoustic member. Alternatively the base may be defined by the surface on which the loudspeaker stands. The loudspeaker may be mounted on a plinth, a foam or rubber-type strip mounted on the base edge of each acoustic member or on discreet feet or foot-like extensions to the acoustic members themselves. Alternatively, the suspension for the acoustic members may be in the form of a foam or rubber type strip in a moulded groove, a foam or rubber type strip bonded to a surface of the acoustic member or a 'wrap around' moulding.

According to another aspect of the invention there is provided a method of making a bending wave panel-form loudspeaker comprising selecting at least two bending wave panel-form acoustic members each having a set of modes which are distributed in frequency, such that the modal distributions of each acoustic member are substantially different and assembling the acoustic members such that the modal distributions of the assembly of acoustic members are interleaved constructively in frequency, and coupling a transducer to the assembly to apply bending wave energy to the acoustic members to cause them to resonate to produce an acoustic output.

The method may comprise making the assembly of acoustic members from a single piece of stiff lightweight sheet material. The acoustic members may be defined in the single piece of sheet material by forming, e.g. by local compression, at least one groove in the sheet material. A parallel pair of grooves may be formed and the grooves may be arranged to enable the sheet material to be folded.

The method may comprise coupling at least two of the acoustic members together such that bending wave energy is transmissible between the acoustic members. The coupling may be such as to allow flat-packing of the assembly.

The stiff lightweight sheet material may be of the kind comprising face skins sandwiching a corrugated core and the assembly may be arranged to define a front face having a base and at least one side face having a base. The corrugated core may be arranged so that in the front face its corrugations extend perpendicular to the base and in the side face its corrugations are at an acute angle to its base.

The set of modes of each acoustic member start from a fundamental or lowest mode and are defined by parameters, including geometry and properties of the material of the acoustic member. The method may thus comprise selecting the parameters of the acoustic members from the group consisting of geometry, size, surface mass density, bending stiffness, internal self damping and anisotropy or isotropy of bending stiffness or thickness. The lowest mode may be determined by the size of the largest individual acoustic member. Accordingly, the size of the largest acoustic member may be selected so that the output of the loudspeaker extends to a desired low frequency limit. The lowest mode of an acoustic member may be selected to be below the fundamental resonant frequency of a transducer coupled thereto, e.g. at least 2 or 3 octaves below. By appropriate parameter selection, acoustic members may have modes as low as 5 Hz and by using a transducer with a fundamental inertial resonance of 40 Hz, the fundamental resonance or whole body bending mode of an acoustic member does not contribute to the acoustic output. Thus, the output may be modally dense and phase decorrelated across the frequency range.

The method may comprise providing a plurality of discrete transducers and selecting them to have different fundamental resonant frequencies. In particular, use of different types of low frequency exciters with different fundamental resonant frequencies will spread the effect of these resonances for the loudspeaker.

In normal operation, a transducer coupled to drive an acoustic member may stiffen the material of the acoustic member directly underneath the transducer coupler. In particular, the circular area of acoustic member enclosed by a voice coil of a moving coil transducer sustains intense tympanic modes which are coherent and remain geometrically organised. The frequency at which this localised resonance occurs is known as the aperture resonance frequency and depends upon the shape of the footprint of the coupler and the properties of the acoustic member. The discrete transducers may be selected to have coupler footprints of different sizes, i.e. different diameter voice coils, such that their respective aperture resonances are at different frequencies. Alternatively, a combination of moving coil and piezo transducers may be used. Each aperture resonance mode may be constructively interleaved with the modal distributions of the acoustic members.

Further features and advantages of the invention, as well as the structure and operation of various embodiments of the invention, are described in detail below with reference to the accompanying drawings.

BRIEF DESCRIPTION OF DRAWINGS

Embodiments that incorporate the best mode for carrying out the invention are described in detail below, purely by way of example,. with reference to the accompanying drawings, in which.

Figure 1:
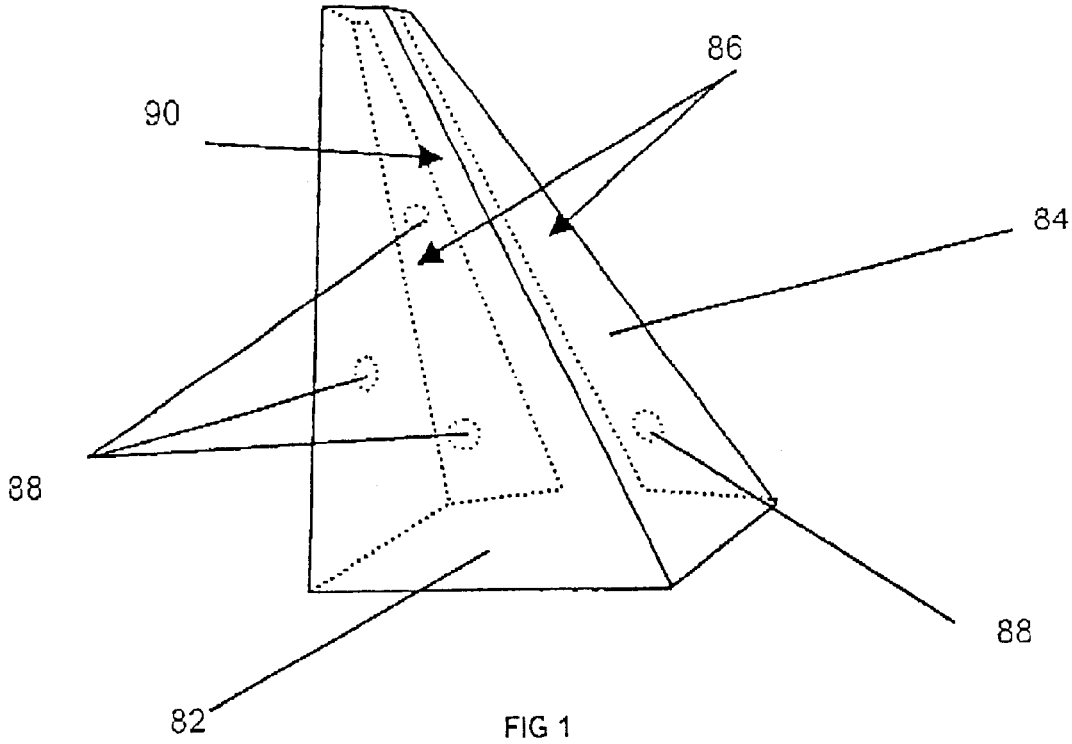
FIG. 1 is a perspective view of a loudspeaker according to the present invention.

It is to be understood that the invention is not limited in its application to the details of construction and the arrangement of components of preferred embodiments described below and illustrated in the drawing figures.

DETAILED DESCRIPTION

Figure 2:
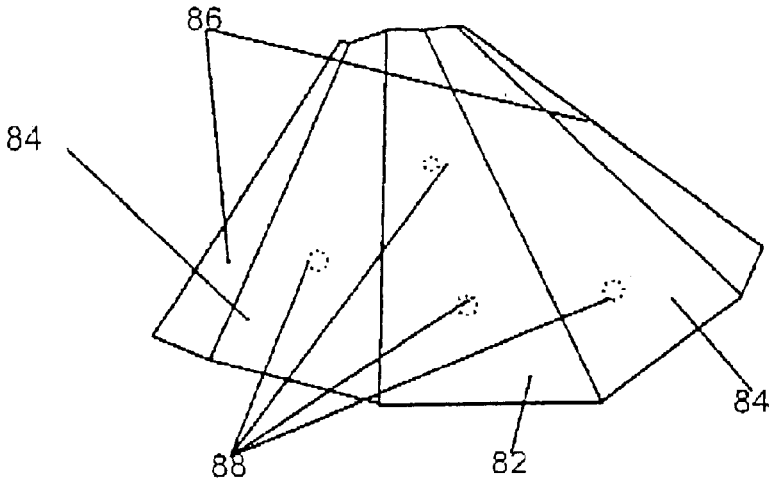
FIG. 2 is a plan view of the cardboard blank used to form the loudspeaker shown in FIG. 1.

FIGS. 1 and 2 shows a first embodiment of the present invention in which the speaker is generally in the form of a truncated square based pyramid. FIG. 1 shows the speaker in an assembled use position and FIG. 2 shows the blank of corrugated cardboard which is folded to form the speaker.

The speaker comprises a front face 82, two side faces 84 and a rear face having two sections 86 separated by a gap 90 which acts as a vent to the loudspeaker. Thus, the speaker defines a volume which is substantially closed. A single transducer 88 is mounted to each of the side faces 84 and a pair of transducers are mounted to the front face 82 whereby each face forms a separately driven panel-form bending wave acoustic radiator or member. The rear face 86 is passive but may be modally active via hinge coupling as explained below. Accordingly, the loudspeaker of this embodiment comprises an assembly of five bending wave panel-form acoustic members at least three of which are driven directly by transducers to produce an acoustic output.

In accordance with the invention, each acoustic member or face is a different shape and size so that the modal distributions of each acoustic member are substantially different and may be constructively interleaved. Each of the front and side faces 82,84 are generally in the form of truncated triangles with top edges of length 10 cm. The front face 82 has a base of length 56 cm and a generally perpendicular side of 100 cm. Each of the side faces 84 are generally in the form of isosceles triangles with base angles of approximately 80° and bases of length 47 cm. The sections 86 forming the rear face are generally triangular with bases approximately 20 cm in length and free edges of approximately 100 cm.

As shown, the loudspeaker of FIG. 1 has no parallel surfaces or edges. Thus colouration from internal standing waves within the speaker should be suppressed. Furthermore, each acoustic member is placed in a different orientation which increase the complexity of the speaker's interaction with the environment and audience compared to a single panel-form acoustic member. Thus, preferential stimulation of individual standing waves in the room and the 'sweet listening spot' may be removed or reduced.

In all embodiments, the transducer location may be chosen to couple substantially evenly to the resonant bending wave modes. In other words, the transducer may be at a location where the number of vibrationally active resonance anti-nodes is relatively high and conversely the number of resonance nodes is relatively low. In this embodiment, this is achieved by locating the transducers 88 on the front face a distance of 90 cm and 30 cm from its base and 14 cm and 30 cm from its generally perpendicular side respectively. The transducer 88 on the side face joined by the generally perpendicular side to the front face is mounted to the side face at a distance of 16 cm from the generally perpendicular side and 40 cm from the base of the side face. The transducer on the other side face is mounted at a distance of 18 cm from the sloping side of the front face and 25 cm from the base of the side face.

Figure 3:
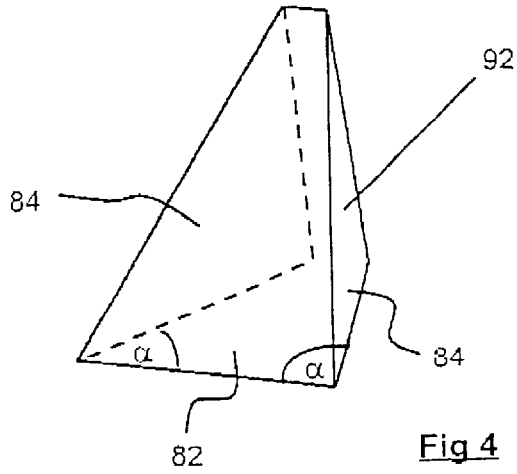
FIGS. 3 and 4 are perspective views of loudspeakers according to alternative embodiments.
Figure 4:
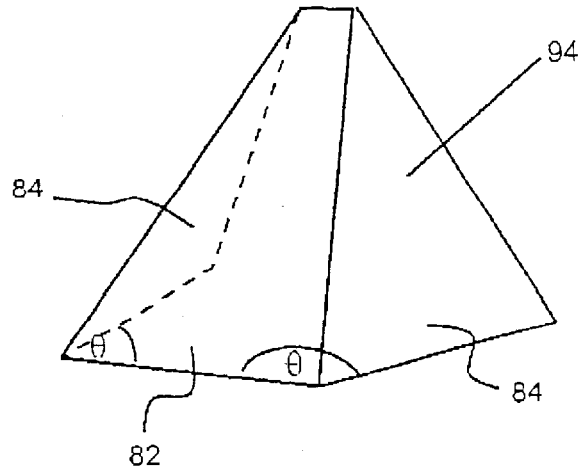

The rear face 86 controls the motion of the rear edges of the side faces 84. The rear face adds to the effective baffle size, whereby bass response may be improved. The baffle shape may be adjusted to suit different room sizes or acoustic requirements. Alternative baffling arrangement are shown in FIGS. 3 and 4 in which a loudspeaker comprises a truncated triangular front face 82 and two triangular side faces 84. The front face 82 is driven by a transducer (not shown) and the side faces 84 act as baffles. The rear edges of the side faces define a gap which may be considered an open rear face 92, 94.

FIG. 3 shows a substantially closed baffle in which the rear edges of the side faces almost meet. Thus, the open rear face 92 is small and the lower edge of each side face is at an acute angle $\alpha$ to the lower edge of the front face. FIG. 4 shows a substantially open baffle in which the open rear face 94 is large and the lower edge of each side face is at an obtuse angle $\theta$ to the lower edge of the front face. More open baffles generally have greater bass weight.

Figure 5:
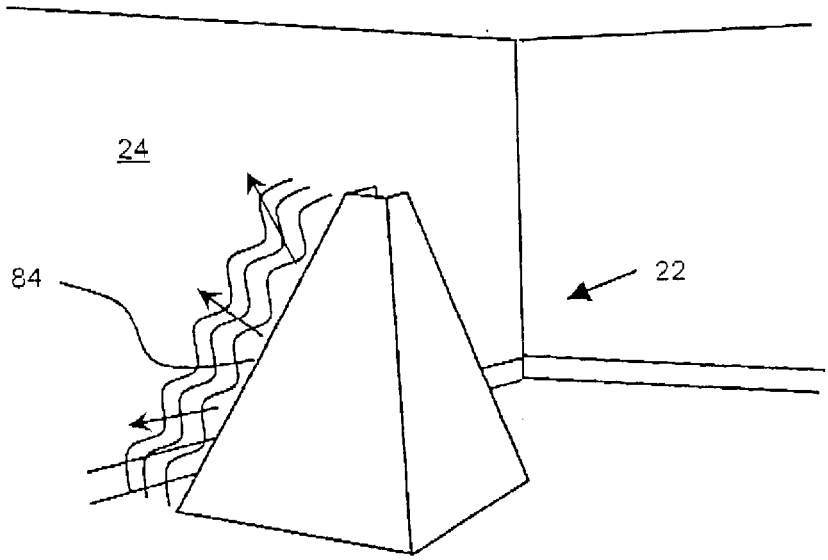
FIG. 5 is a perspective view of a loudspeaker according to another aspect of the invention adjacent a wall.

FIG. 5 illustrates a loudspeaker 22 which is generally similar to that of FIG. 3 mounted adjacent a wall 24. Since the side face 84 adjacent the wall 24 is at an angle to the wall, the coherence of the radiation reflected by the wall 24 is smeared to give the benefit of lower room colouration and better stereo focus. The off-axis radiation from the other side face and the front face also contributes to smear the reflections. The loudspeaker can sit on a carpeted floor which defines the termination conditions on the lower edge or base of all the acoustic members. This increases the length of the shortest acoustic path for leakage and may effectively double the baffle size.

Figure 6:
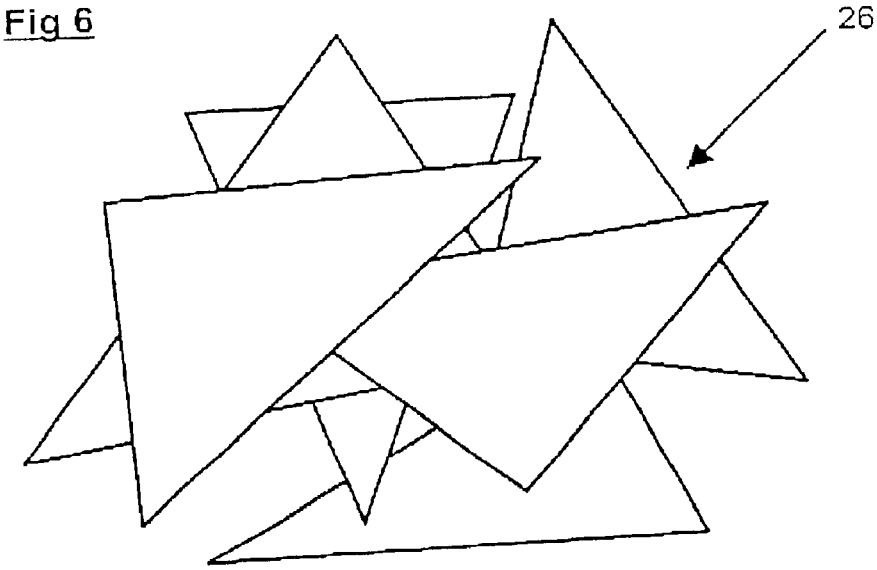
FIGS. 6 to 10*c* are plan views of the loudspeaker according to alternative embodiments.
Figure 7:
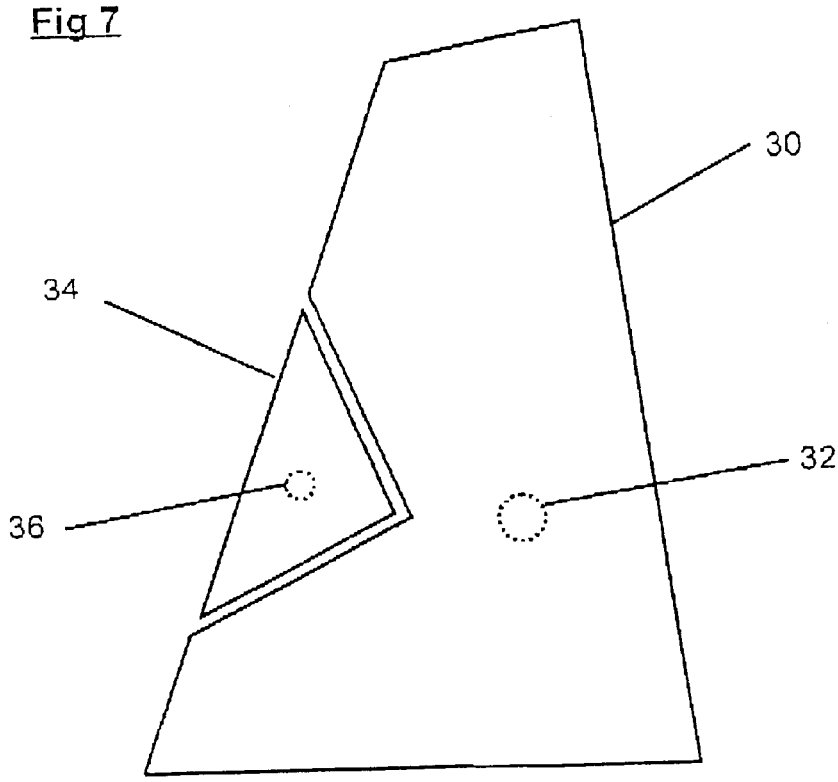

FIGS. 1 to 5 show loudspeakers in which the assembly of acoustic members defines a volume. Alternatively, the acoustic members may generally be arranged in the same plane as shown in FIGS. 6 to 10. In FIG. 6, the assembly of acoustic members 26 forms a heap which may be geometrically ordered or pseudo-random and in which the members may be separate or connected. In FIG. 7 the assembly comprise a large acoustic member 30 having a larger, low-frequency transducer 32 and a smaller acoustic member 34 to which a smaller, mid/high frequency transducer 36 is mounted. The large truncated triangular member 30 partially surrounds the smaller triangular member 34. More smaller members may be used and the large member 30 may be arranged to completely or partially surround each smaller member 34.

Figure 8:
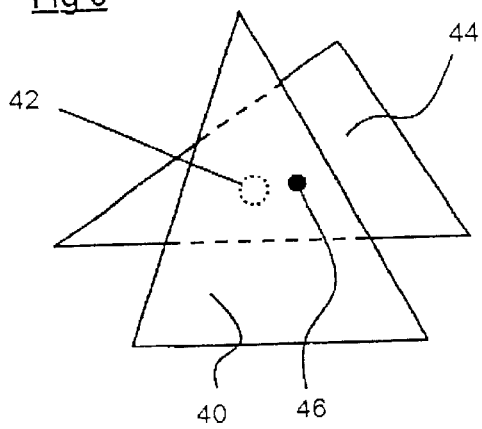

In FIG. 8, the assembly comprise a front triangular acoustic member 40 which is mounted above and at an angle to a rear triangular acoustic member 44 so that the rear member 44 is partly obscured by the front member 40. The angle may be adapted so that the rear member 44 is completely obscured. The front acoustic member 40 is driven by a transducer 42 and the rear acoustic member 44 may be actively driven by its own transducer (not shown) or passively driven from the front acoustic member 40 by way of an acoustic coupling 46. Such a coupling, in the form e.g. of a pin or pins, is preferably coupled to the members at points at which high velocity motion in the main modes is to be found. Pin or pins 46 may also act as masses, affecting the modes in one or both members as is known.

Figure 9:
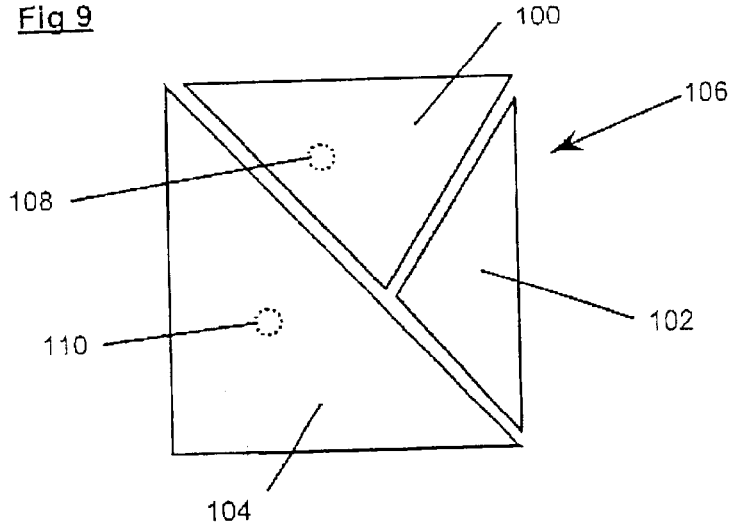

Referring to FIG. 9, the loudspeaker comprises an assembly of acoustic members in the form of flat triangular panels 100, 102, 104 arranged in the same plane and tessellated to form a composite super panel 106. Transducers 108,110 are mounted to the two larger panels 100 and 104 whereby they are active and the smallest panel 102 is passive.

Figure 10A:
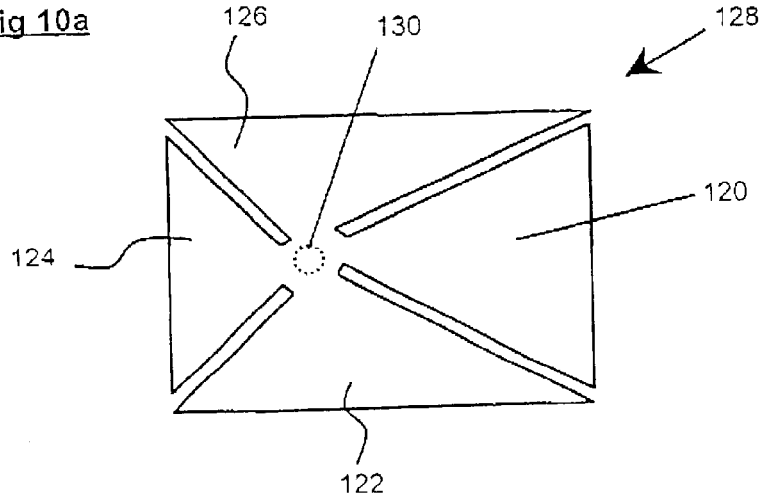

FIG. 10*a* shows an of acoustic members in the form of panels 120, 122, 124, 126 which are arranged in the form of an irregular or skewed Maltese cross 128. A transducer 130 is mounted to the assembly at the centre of the cross which is off-centre on the assembly as a whole.

Figure 10B:
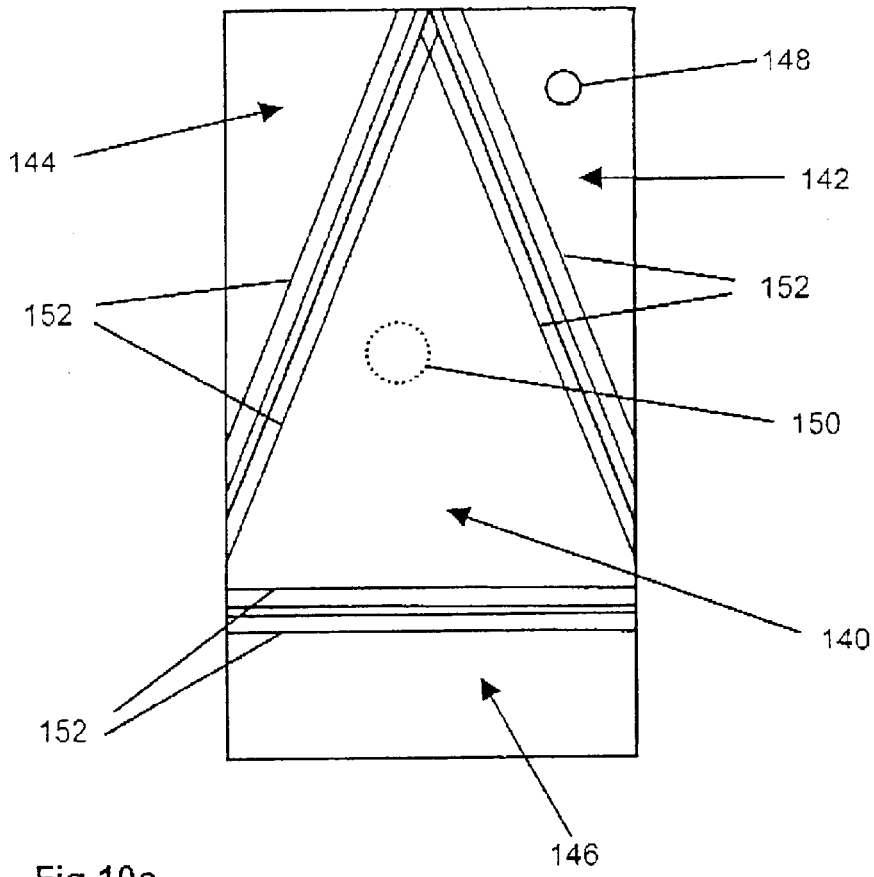

In FIG. 10*b* the assembly comprise a single active isosceles triangle shaped panel 140 driven by transducer 150 and three smaller passively coupled panels 142, 144 and 146. Panels 142 and 144 are right-angled triangles coupled along their hypotenuses, and panel 146 is a rectangle. The panels are held together in a single plane by low shear strength joints 152 (see FIG. 17). A mass load 148 is added to one of the otherwise identical passive right-angled triangles to alter its modality in relation to the other, further increasing modal complexity of the speaker as a whole.

Figure 10C:
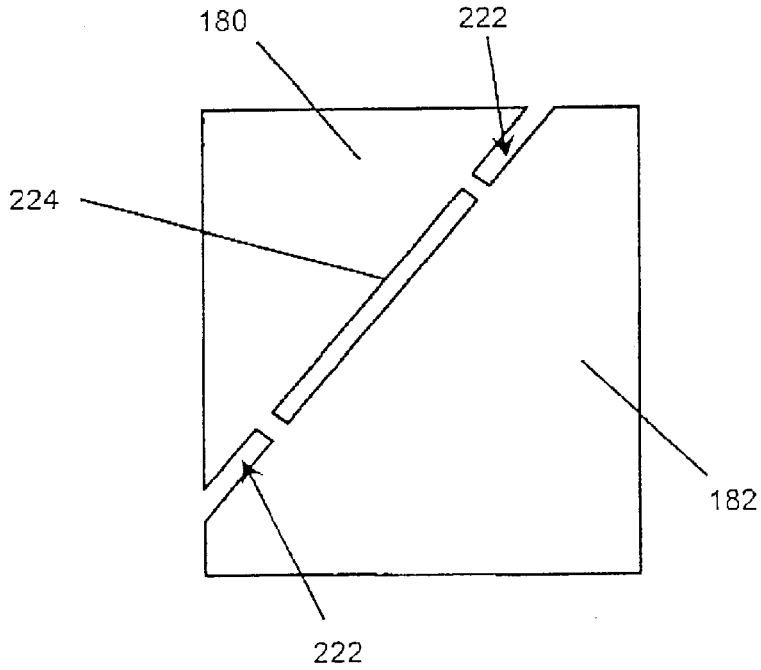

As shown in FIG. 10*c*, a single panel is sub-divided by removing material to provide slots 222, 224 to define separate acoustic members 180, 182 with hard connections 220 between them. Such slots may be open-ended slots 222 or closed slots 224.

The acoustic members or faces of the three-dimensional loudspeakers of FIGS. 1 to 5 are preferably connected by a coupling which allows movement of the acoustic members relative to one another. Thus the coupling(s) may act as hinges of the types illustrated in FIGS. 11 to 16. In FIGS. 11 to 14*b* the hinge is integral with the faces and thus adjacent faces may be formed from a single piece of material. In FIGS. 15*a* and 15*b* the hinge is a discrete member which is connected to both faces and thus both faces may be formed from separate pieces of material.

Figure 11:
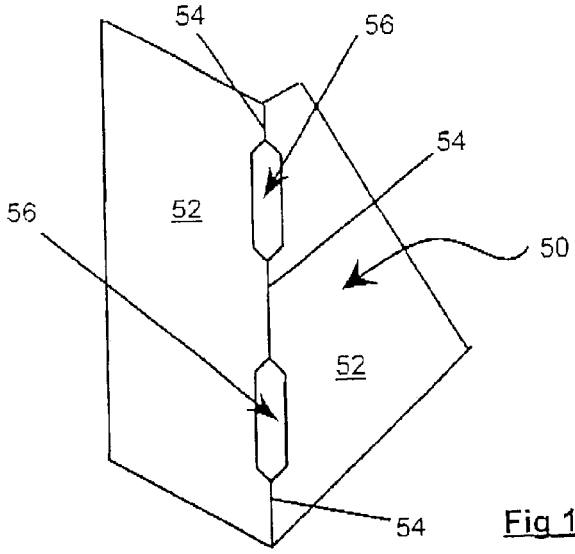
FIGS. 11 and 12 are perspective views of two alternative loudspeakers showing alternative hinge mechanisms.
Figure 12:
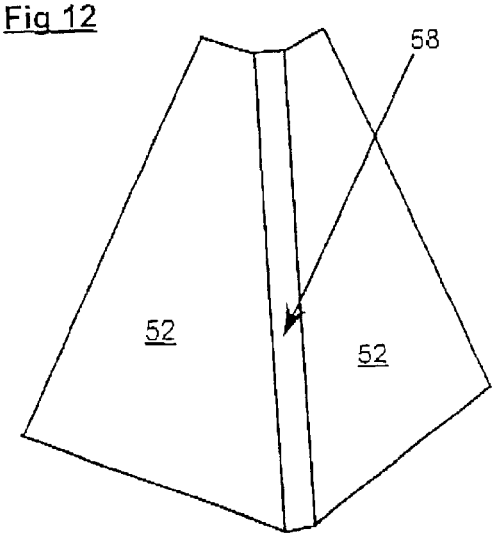

The loudspeaker may be made from a foldable material, e.g. a monolith or a skinned panel with a collapsible core. FIGS. 11 and 12 show hinges which may be achieved by folding such materials. FIG. 11 shows a discontinuous single hinge 50 connecting two faces 52. The hinge 50 comprise folds 54 and cutaway sections or openings 56 between the folds. FIG. 12 shows a hinge having a double fold 58 between two faces 52 which may be used for thicker materials, e.g. cardboard.

Figure 13A:
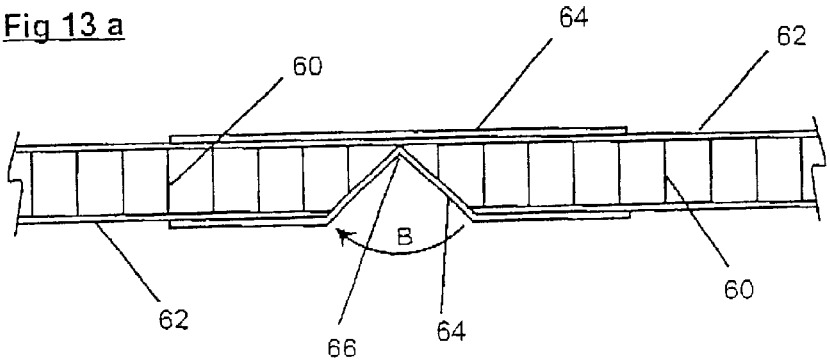
FIGS. 13*a*, 14*a* and 15*a* and 13*b*, 14*b* and 15*b* are exploded cross-sections of alternative hinge mechanisms in the open and closed state, respectively.
Figure 13B:
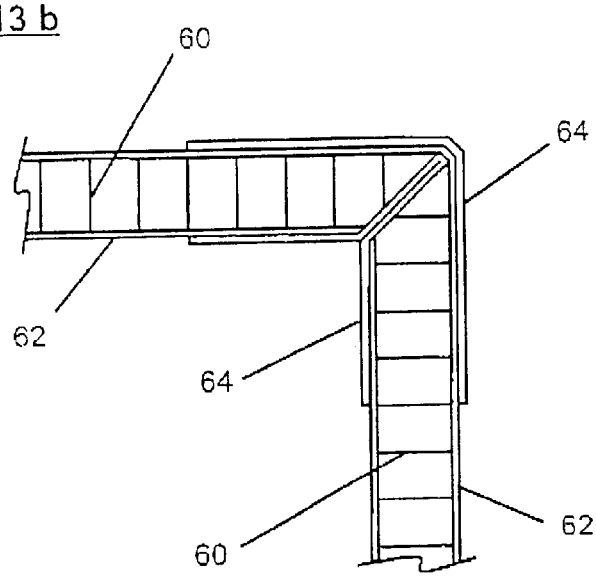

If the face is not made from a foldable material, a hinge can be made with V-grooving per FIGS. 13*a* and 13*b* which show the hinge in its open and closed states. Each face is made from a composite panel which comprises a core 60 sandwiched between two skins 62. A V-shaped section of the core, including one skin, is cut-away with the point of the V-shape defining the fulcrum 66 about which the faces are rotatable relative to each other. One face is rotatable in the direction of Arrow B from a position in which both faces are in the same plane (FIG. 13*a*) to a position in which both faces are perpendicular to each other (FIG. 13*b*). Reinforcing tape 64 is added along both sides of the panel in the region of the groove, the tape runs inside the closed hinge. The reinforcing tape 64 may be replaced by any suitable alternative, e.g. adhesive.

Figure 14A:
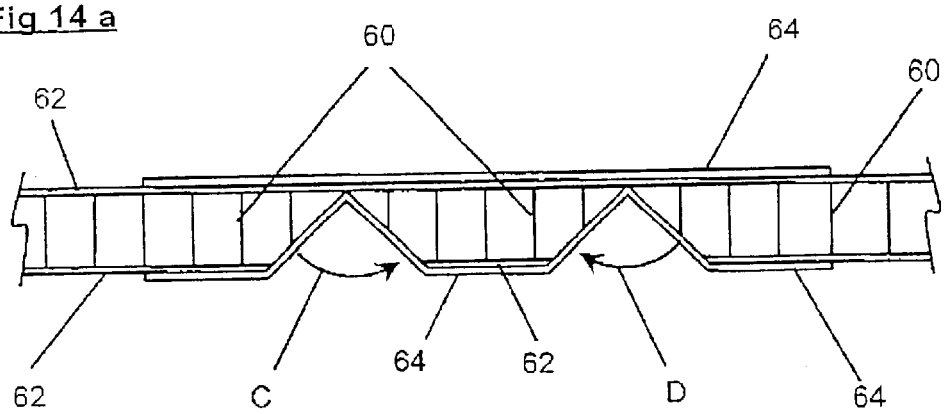
Figure 14B:
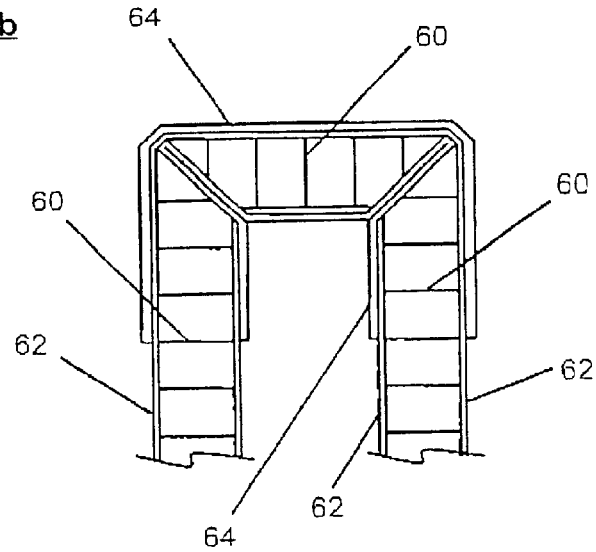
Figure 15A:
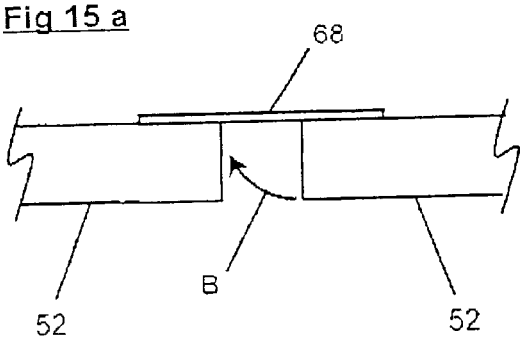
Figure 15B:
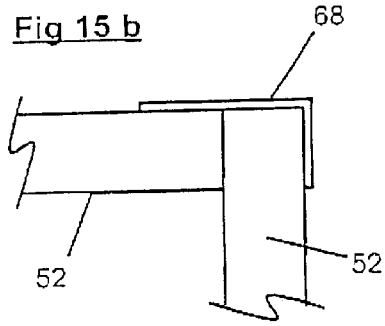

FIGS. 14*a, b* show a double hinge comprising two of the V-grooves illustrated in FIGS. 13*a, b* and thus the same reference numbers are used. Each face is rotated in the directions of arrows C and D from a position in which both faces are in the same plane to a position in which both faces are parallel but not co-planar. Thus 180° of folding is achieved.

FIGS. 15*a, b* show two faces 52 which are spaced apart so as to define a gap which is approximately equal to the thickness of each face and which are connected by a strip of self adhesive tape 68 which forms a hinge. One face is rotatable in the direction of Arrow B from a position in which both faces are in the same plane (FIG. 15*a*) to a position in which both faces are perpendicular to each other (FIG. 15*b*). The tape is chosen to have a high degree of internal damping and a suitable high tack adhesive. If the acoustic member is made from a core which has been milled, the tape may prevent loose edges from rattling and buzzing.

The hinge may be sufficiently flexible to allow the loudspeaker to be flat packed. The flexibility of the hinge may range from substantially resistant to flexing to fully flexible. If fully flexible, the hinge acts as a simply supported edge termination of an excited panel and little or no bending wave energy is transmitted across the hinge. Alternatively, if the hinge resists flexing, i.e. has residual bending stiffness after folding, bending wave energy may be transmitted across the hinge from an excited face to an adjacent face. Although there may be losses as frequencies increase, the hinge may be designed to transmit bending wave energy of all frequencies in the operative range, i.e. at least up to 20 KHz.

Figure 16:
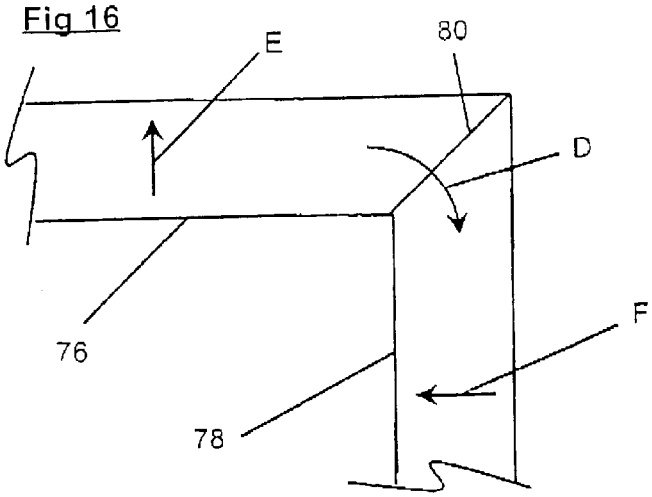
FIG. 16 is an exploded cross-section of a hinge showing the transmission of energy across the hinge.

FIG. 16 illustrates the transmission of bending wave energy from a driven face 76 to an adjacent face 78 across a hinge 80. The bending wave energy in the driven face causes a rotational pivoting action (arrow D) about the longitudinal axis of the hinge 80 which drives bending wave energy into the adjacent face 78. Bending waves from the driven face 76 arrive at the hinge 80 as local lateral angular displacements which are translated by the hinge into opposite polarity displacements in the adjacent face 78. The opposite polarity displacements have equal and opposite angles to the original displacements and drive bending waves into the adjacent face 78 as a result of the areal mass, stiffness and inertia of the face 78. As indicated by arrows E and F which shows the direction of local bending wave vibration in the driven face 76 and the adjacent face 78 respectively, the adjacent face 78 is excited in anti-phase to the driven face 76.

In contrast the acoustic members of the planar loudspeakers of FIGS. 7, 9, 10*a* and 10*b* are preferably connected by a coupling(s) which allow the formation of a self-supporting plate of stable dimensions which may be framed or supported as if it were a single panel. At the same time, the couplings or joints should have low shear strength so as to allow the constituent acoustic members or panels to sustain their own bending wave modes independently of those of their neighbours.

Figure 17:
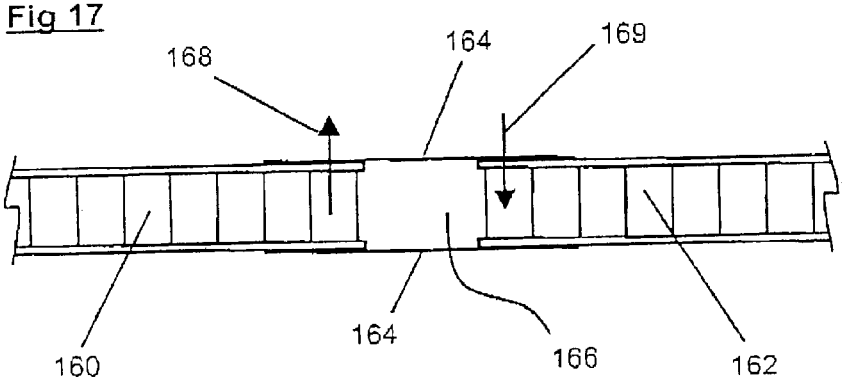
FIGS. 17 to 20, 22 and 24 to 26 are cross-sections showing mechanisms connecting two panels which may be used in loudspeakers according to the present invention.
Figure 18:
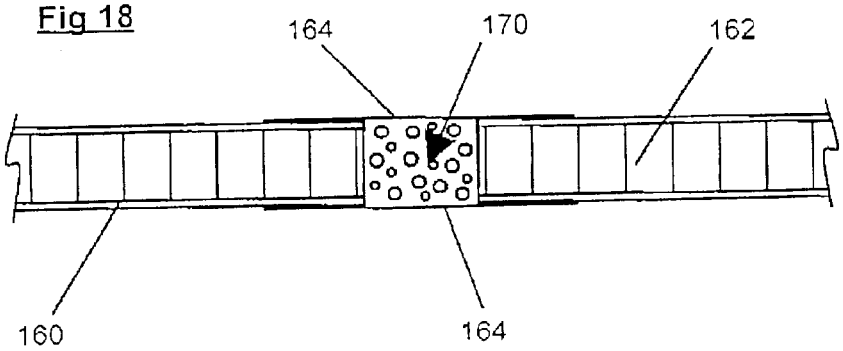

In FIGS. 17 and 18 two panel-form acoustic members 160, 162 are placed adjacent to each other with their proximal edges separated by 1 mm to 2 mm. The coupling is in the form of high tensile films 164 mounted to both the front and rear surfaces of both panels. The film has a thickness less than 200 $\mu$m and an in-plane tensile modulus greater than 1 GPa. As shown by arrows 168, 169, the bending motion of the adjacent edges of the panels 160, 162 is in anti-phase.

In FIGS. 17 and 18, the space 166 enclosed between the panel edges and the films is filled with air or an alternative filling 170. By appropriate selection of the filling, the joint may resist rotation of the panels relative to each other and lateral crushing, i.e. closing the gap between the panels, but have near zero shear strength. The filling may be another gas, a liquid or a flexible foam or fibrous material which may also add damping or frequency dependant stiffening to the joint.

Figure 19:
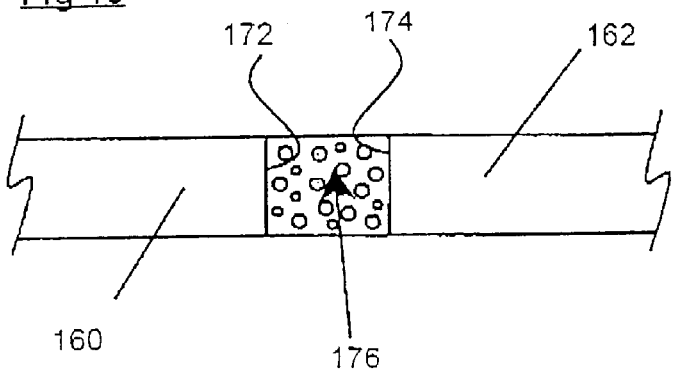
Figure 20:
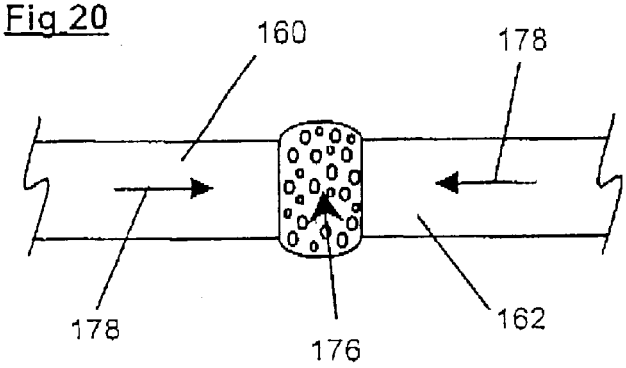

In FIGS. 19 and 20 the coupling is double sided self-adhesive foam plastics tape 176 bonded to the adjacent edges 172, 174 of panels 160, 162. Such a joint has substantially low shear strength, compresses in the plane of the panels, compresses laterally as shown in FIG. 20 and allows a degree of rotational movement the panels relative to each other. The foam 170 may be open or closed cell and the resulting foam joint may be reinforced by tape on one or both sides of the panels. The tape should be flexible, e.g. P.V.C. tape, to allow lateral panel movement in the direction of arrows 178. Such a construction may be useful for automotive applications especially after-market products, custom installations or architectural speakers.

Figure 21:
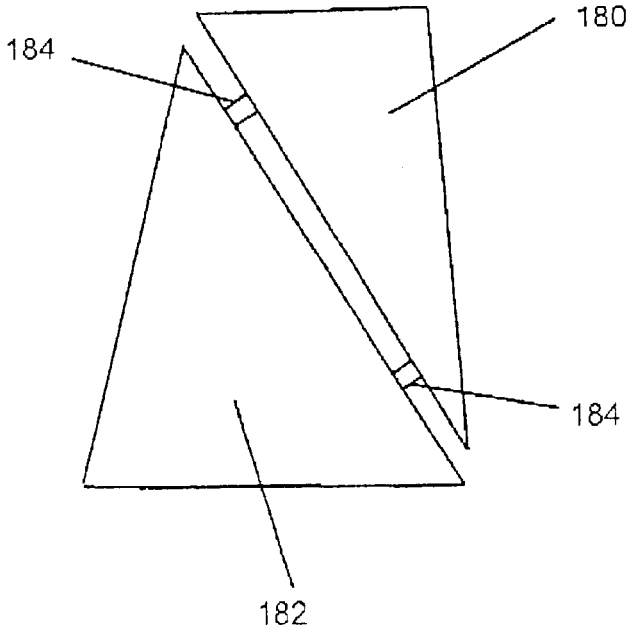
FIGS. 21 and 23 are respectively plan and perspective views of two alternative mechanisms connecting two panels.

As shown in FIG. 21 the couplings 184 are at discrete spaced locations and lock the acoustic members or panels 180,182 together in a set overall geometry while still allowing independent bending mode vibration. The couplings are completely rigid joints and may be as shown in FIGS. 22 to 26.

Figure 22:
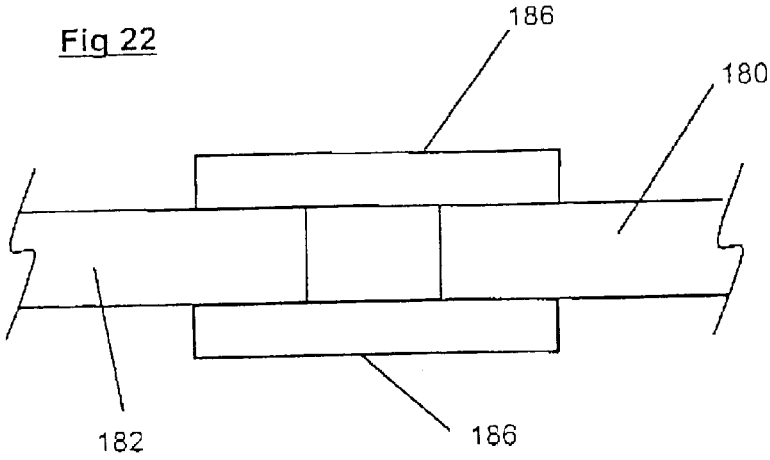
Figure 23:
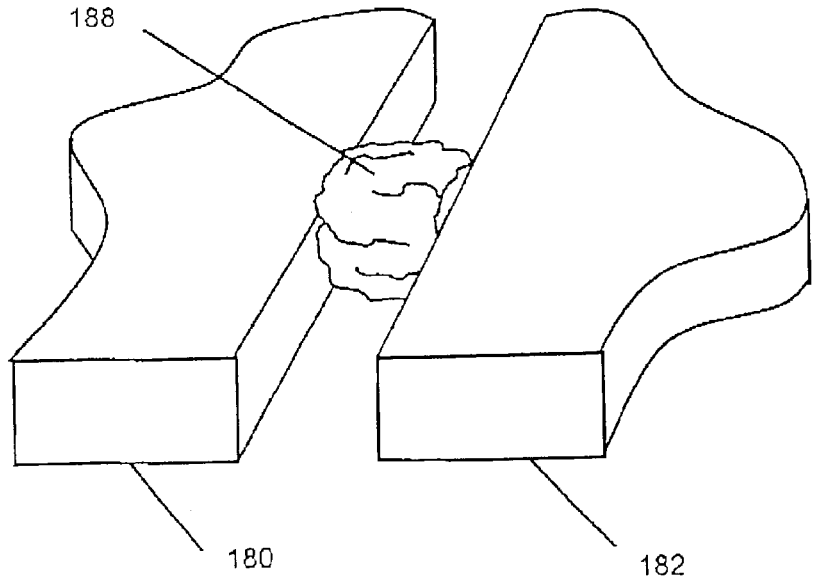
Figure 24:
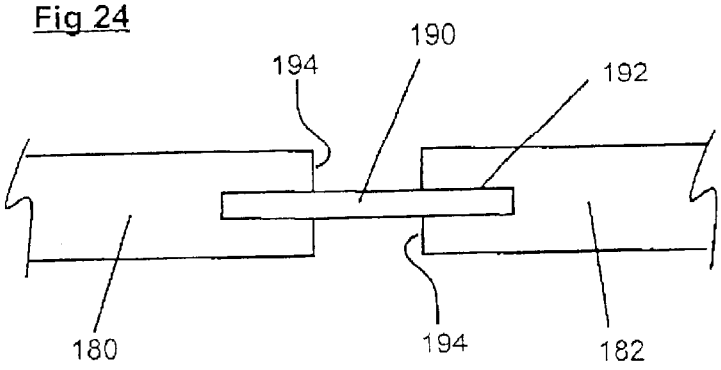
Figure 25:
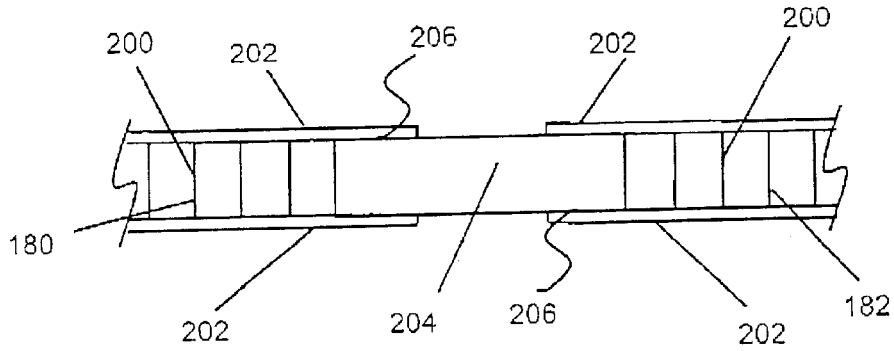
Figure 26:
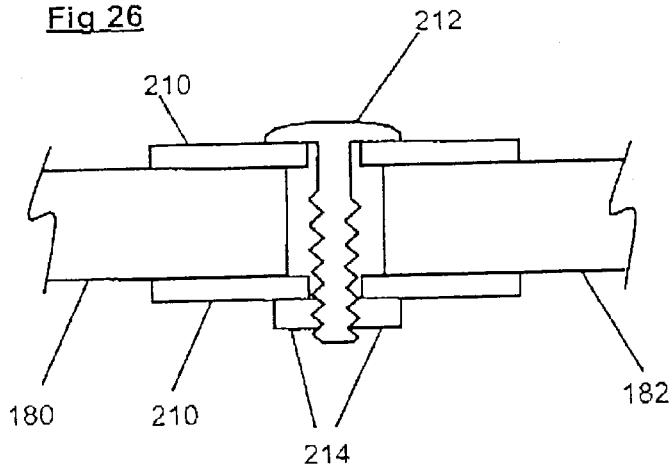

In FIG. 22 the joint comprises substantially rigid ribs 186 bonded to both of the surfaces of the panels 180, 182 across the gap between them. In FIG. 23 the joint comprises a lump 188 of hard setting glue or other similar material. In FIG. 24 a substantially rigid pin 190 is be located in holes 192 in the edge face 194 of each panel 180, 182. In FIG. 25, the panels 180,182 are of composite construction comprising a core 200 sandwiched between skins 202 and the joint comprises a substantially rigid bar 204 locating in a recess 206 cut into the core 200 in the edge face of each panel. FIG. 26 shows a nut and bolt 214, 212 arrangement clamping panels 180, 182 between washers 210.

Figure 27A:
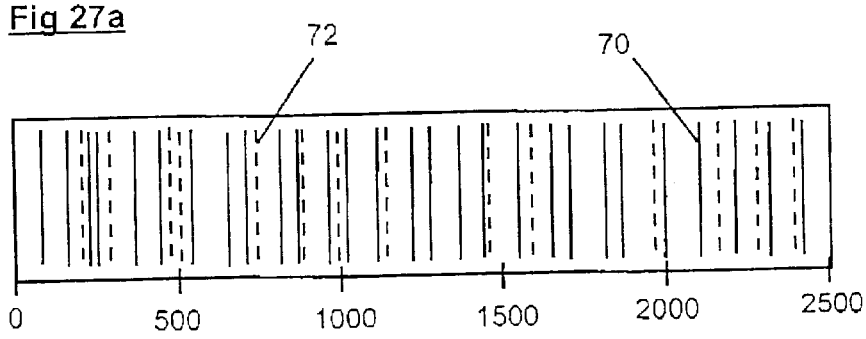
FIGS. 27*a* and 27*b* show the distribution of modes in frequency for two similarly shaped bending wave panels.
Figure 27B:
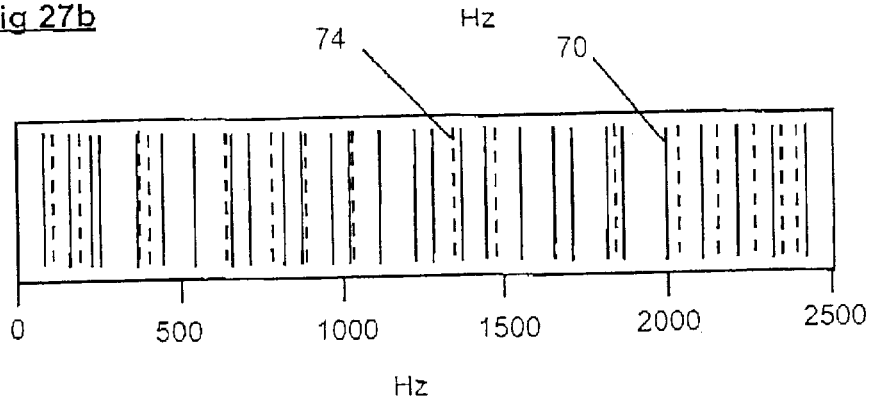

FIG. 27*a* shows the modal distributions 70,72 for a large triangular panel-form acoustic member and an acoustic member of a similar shape which is 50% smaller respectively. FIG. 27*b* shows the modal distributions 70, 74 for the same large acoustic member and an acoustic member of a similar shape which is 20% smaller respectively. Since the members have a similar shape, the relative spacing of the modes in each distribution is the same. Nevertheless, the distribution for the larger acoustic member is substantially different to that of the smaller member, for example it is more dense, more evenly distributed and extends to lower frequencies. As shown, the modes of the individual member interleave constructively in frequency.

Figure 28:
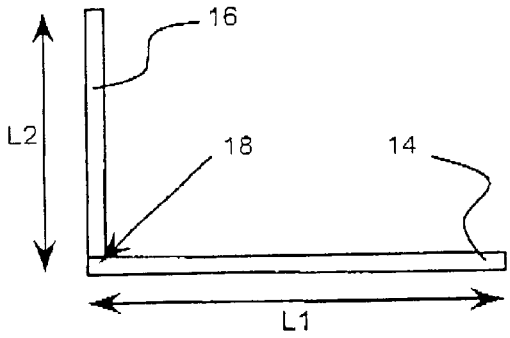
FIG. 28 is a plan view of a two beam loudspeaker.

A recipe for improving the overall modal distribution may be developed from the simple case shown in FIG. 28 in which two beams 14, 16 of length L1 and L2 are joined together at one end. The joint 18 is rigid and is assumed to satisfy a simply supported boundary condition and any transmission of bending wave energy around the joint is by rotational movement. The modal frequencies of this simple case follow a basic spacing set by the combined length. The actual spacing of frequencies is modulated at a rate determined by the difference the ratio of the two lengths, namely aspect ratio $\alpha$ which is defined as L1:L2.

Figure 29:
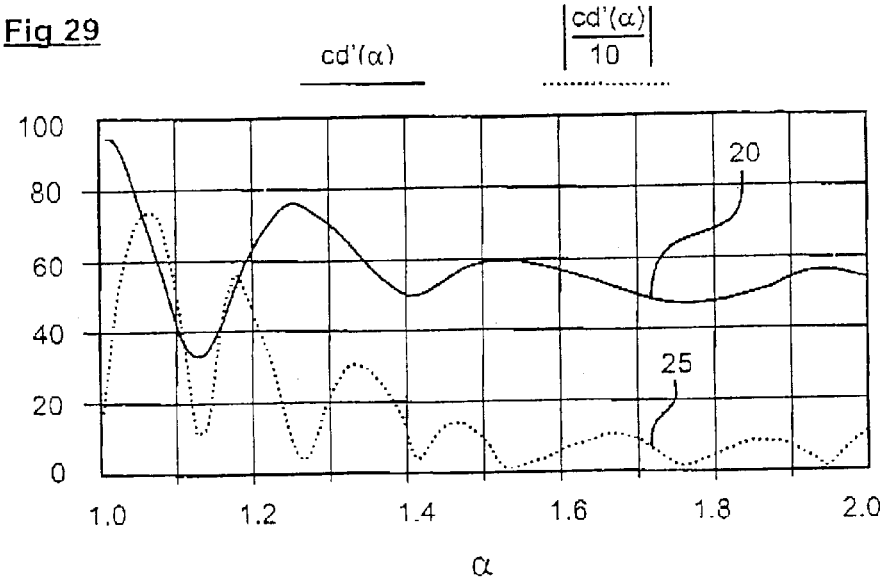
FIG. 29 is a graph of cost function against alpha for the loudspeaker for FIG. 28.

FIG. 29 shows two graphs which are useful for determining the optimal aspect ratio from the calculated modal frequencies for this simple loudspeaker. The first graph 20 shows cost function cd (i.e. central difference of modal frequencies) against aspect ratio with the troughs in the graph indicating the best aspect ratios. The second graph 25 shows the differential of cd with respect to $\alpha$ with the first, third and fifth troughs in the graph indicating good values of aspect ratio. From the graphs, the optimal aspect ratio is 1.134 i.e. $\sqrt{(9/7)}$, with good results achieved for aspect ratios of 1.41, i.e.$\sqrt{2}$, and 1.76.

The cost function may be defined as follows:

$$cd(n, N, \alpha) := \left| \begin{array}{c} r \leftarrow \xi n(n, \alpha) \\ \text{for } m \in 0 \ldots N \\ f_m \leftarrow \lambda(n, m, r)^2 \\ cf \leftarrow 0 \\ \text{for } m \in 1 \ldots N-1 \\ cf \leftarrow cf + (f_{m-1} + f_{m+1} - 2 \cdot f_m)^2 \\ \sqrt{\dfrac{cf}{N-1}} \end{array} \right.$$

where $f_m$ is the modal frequency, r is a vector of lengths in the appropriate ratios (1: a : a2: . . . aN), and of total length 1.

ξ is a function to return r as a function of n (number of beams) and α.

Since the cost function measures the central difference of the modes, it gives an indication of the distribution of the modes in frequency. Accordingly, when the cost function is minimised, the modes are more evenly distributed in frequency, i.e. any "bunching" or clustering of the modes is reduced. An alternative but equivalent expression for the cost function taught in U.S. patent application Ser. No. 09/300,470 (filed Apr. 28, 1999) (incorporated by reference in its entirety) is:

$$SEE(f) := \sqrt{\frac{1}{last(f)-3} \sum_{m=1}^{last(f)-1} (f_{m+1} + f_{m-1} - 2 \cdot f_m)^2}$$

Figure 30:
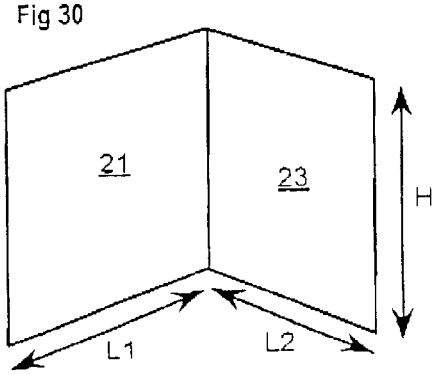
FIG. 30 is a perspective view of a two panel loudspeaker.

The result may be extended to two rectangular panels 21, 23 as shown in FIG. 30 since two such panels may be considered as a series of beams. The two panels have identical height H and lengths L1 and L2. Setting the lengths L1 and L2 in the optimal aspect ratio for two beams, namely α=√(9/7) and calculating a cost function as before, the optimal ratio for the height H to the widest panel is also √(9/7). Thus, the ratio of the dimensions, namely L1:L2:H is equivalent to 1: √(9/7):9/7.

Figure 31:
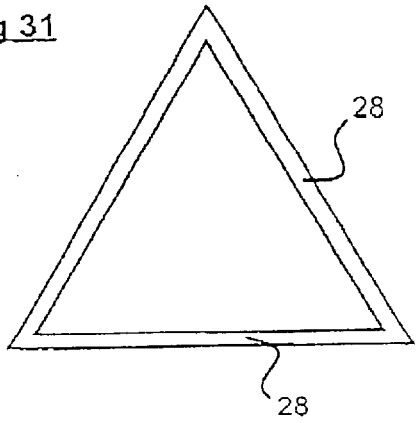
FIGS. 31 and 32 are plan views of three and four beam ring loudspeakers.
Figure 32:
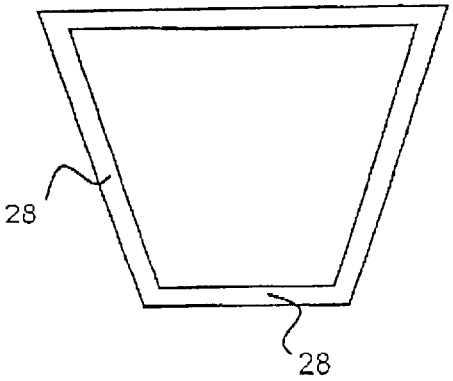

The result may also be extended to a ring of n beams 28 and hence to a loudspeaker having n panels where n is at least 3 and the beams have a ratio of lengths which is determined by 1: α: $\alpha^2$: . . . $\alpha^N$. Rings of three and four beams 28 are shown in FIGS. 31 and 32. The following cost function was plotted against α for a ring having three beams and good values of α are in the range 1.1 to 1.2 and 1.4 to 1.5.

Figure 33A:
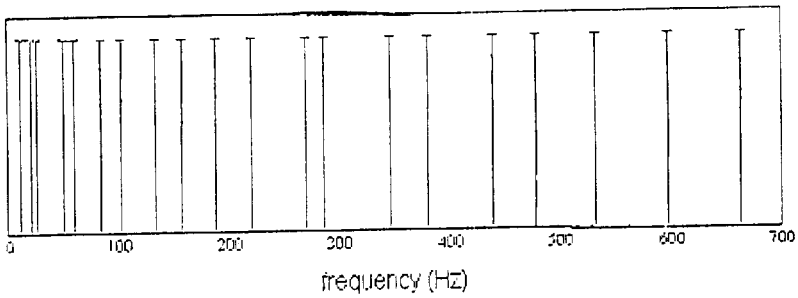
FIGS. 33*a* and 33*b* show the modal distributions in frequency for three and four beam rings of FIGS. 31 and 32 respectively.
Figure 33B:
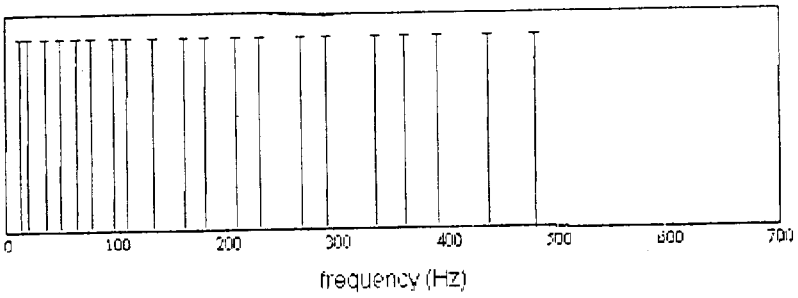

FIGS. 33*a* and 33*b* show the modal distributions in frequency for three and four beam rings of FIGS. 31 and 32 respectively. In each ring the longest beam has unit length and thus both rings have the same lowest mode which occurs at about 10 Hz. In the frequency range of 10–550 Hz the three and four beam rings have 18 and 20 modes respectively. Thus by adding an extra ring, the number of modes in a given bandwidth is increased and hence the density of the modal distribution is increased. Furthermore, the modes are more evenly distributed in frequency, particularly below 200 Hz.

Figure 33C:
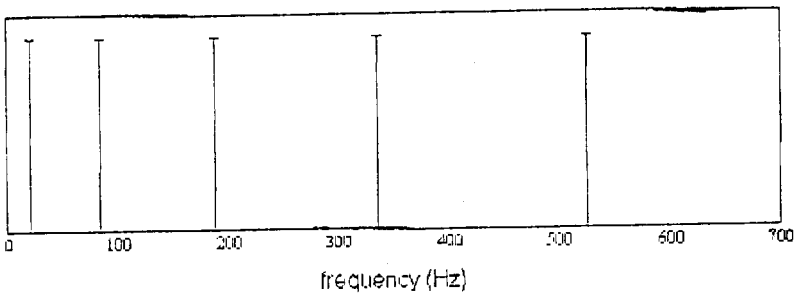
FIG. 33*c* shows the modal distribution in frequency for the fourth beam which is added to the three beam ring to form the four beam ring.

FIG. 33*c* shows the modal distribution in frequency for the fourth beam which is added to the three beam ring to form the four ring beam. The modal distribution of the fourth beam is substantially different to that of the three beam ring, i.e. there are no modes occurring at the same frequency. The modal distributions of the fourth beam and three beam ring overlap since they both have modes in the frequency range shown, i.e. approximately 20 Hz to 550 Hz. As shown, the distribution of modes for the four beam ring is not the sum of the sets of modes for the three beam ring and the fourth beam.

Figure 34A:
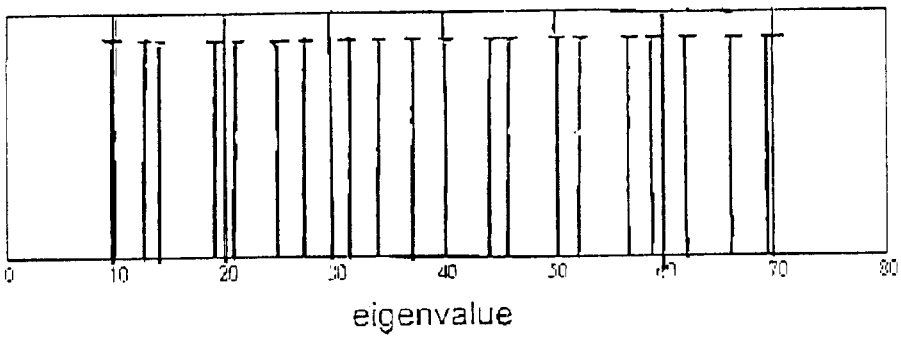
FIGS. 34*a* to 34*c* show the modal distributions for three, four and five beam rings.
Figure 34B:
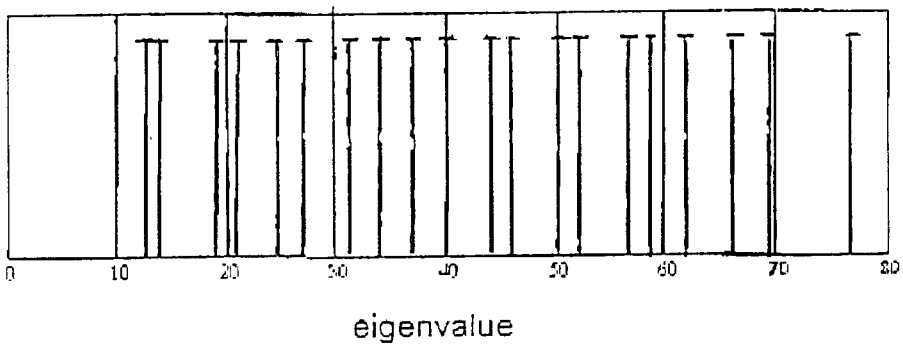
Figure 34C:
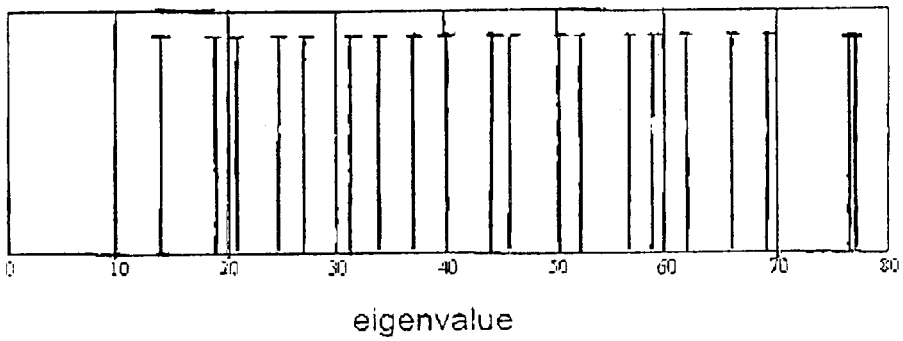

FIGS. 34*a* to 34*c* show the modal distribution for three, four and five beam rings with the overall length of the ring being fixed at unit length. The size of the largest beam thus decreases with increasing number of beams. As shown in FIGS. 34*a* to 34*c* the lowest modes occur at eigenvalues of 9.5, 13 and 14 for the three, four and five beam rings respectively. Since the frequency at which the modes occur is proportional to the squares of the eigenvalues, the lowest mode of the beams decreases in frequency and hence the lower frequency limit of bandwidth of the speaker increases as the size of the largest beam increases. The spacing of the modes is identical in each of the Figures since the combined size of the ring is identical in each case.

Although the above teaching relates to panel dimensions, similar results may be achieved by altering other panel parameters. The aim is to optimise the ratio of the fundamental modes of the panels. If the materials and thicknesses are identical, the ratio of the modes is just the square of the ratio of lengths. Thus, the optimal ratio of fundamental frequencies for the simple two beam or two panel cases above is 1:9/7 and for n beams is 1:9/7: . . . $9^n/7^n$. This may be achieved by altering any parameter, including isotropy or anisotropy of bending stiffness or thickness or related parameters.

While the invention has been described in detail and with reference to specific embodiments thereof, it will be apparent to one skilled in the art that various changes and modifications can be made therein without departing from the scope of the invention. Thus, the breadth and scope of the present invention should not be limited by any of the above-described exemplary embodiments, but should be defined only in accordance with the following claims and their equivalents.

What is claimed is:

1. A loudspeaker, comprising:

an assembly of a plurality of bending wave panel-form acoustic members each having a set of modes which are distributed in frequency, the parameters of at least two of the acoustic members being selected so that the modal distributions of each acoustic member are substantially different and the arrangement being such that the modal distributions of the assembly of acoustic members are interleaved constructively in frequency; and at least one transducer to apply bending wave energy to the acoustic members to cause them to resonate to produce an acoustic output.

2. A loudspeaker according to claim 1, wherein said at least two acoustic members are coupled together by a coupling such that bending wave energy is transmissible between said acoustic members.

3. A loudspeaker according to claim 2, wherein the assembly of acoustic members comprises a single piece of stiff lightweight sheet material and wherein the coupling is formed by at least one fold in the sheet material.

4. A loudspeaker according to claim 3, wherein the fold between at least two adjacent acoustic members comprises a parallel pair of folds.

5. A loudspeaker according to claim 3 or claim 4, wherein the folds are formed by grooving the sheet material.

6. A loudspeaker according to claim 5, wherein the grooving comprises local compression of the sheet material.

7. A loudspeaker according to claim 2, wherein the coupling is sufficiently flexible to allow flat-packing of the assembly.

8. A loudspeaker according to claim 2, wherein the assembly of acoustic members comprises a plurality of discrete acoustic members made from stiff lightweight sheet material and wherein the coupling comprises coupling members.

9. A loudspeaker according to claim 2, wherein the coupling is discontinuous.

10. A loudspeaker according to claim 1 or claim 2, wherein the assembly of acoustic members comprises a single piece of stiff lightweight sheet material.

11. A loudspeaker according to claim 3, wherein the stiff lightweight sheet material comprises a corrugated board having face skins sandwiching a corrugated core.

12. A loudspeaker according to claim 11, wherein the assembly comprises a front face having a base and at least one side face defining a volume, and wherein the corrugated core in the front face is arranged so that its corrugations extend perpendicular to the base.

13. A loudspeaker according to claim 12, wherein the at least one side face has a base and wherein the orientation of the corrugations in at least one side face is at an acute angle to its base.

14. A loudspeaker according to claim 1 or claim 2, wherein the assembly of acoustic members comprises a plurality of discrete acoustic members made from stiff lightweight sheet material.

15. A loudspeaker according to claim 1, wherein the acoustic members are of different areas.

16. A loudspeaker according to claim 1, wherein the acoustic members are of different shapes.

17. A loudspeaker according to claim 1, wherein the acoustic members differ in their mechanical parameters.

18. A loudspeaker according to claim 1, wherein the assembly of acoustic members defines a volume.

19. A loudspeaker according to claim 1 or claim 2, wherein at least one of the acoustic members is of a substantially triangular shape.

20. A loudspeaker according to claim 19, wherein the assembly comprises an assembly of at least two acoustic members of substantially triangular shape.

21. A loudspeaker according to claim 20, wherein the assembly forms a truncated pyramid.

22. A loudspeaker according to claim 21, wherein the plane of the truncation is angled with respect to the plane of the base of the pyramid.

23. A loudspeaker according to claim 19, wherein the assembly comprises a front face and side faces defining a volume, the arrangement having a rear opening.

24. A loudspeaker according to claim 23, wherein the assembly comprises an opposed pair of rear faces between which the rear opening is defined.

25. A loudspeaker according to claim 1, wherein the at least one transducer comprises respective vibration transducers attached to respective acoustic members.

26. A loudspeaker according to claim 1, wherein the at least one transducer comprises an inertial electrodynamic device comprising a coil assembly coupled to the radiator and a magnet assembly resiliently suspended on the radiator.

27. A method of making a bending wave panel-form loudspeaker, comprising:

selecting at least two bending wave panel-form acoustic members each having a set of modes which are distributed in frequency, such that the modal distributions of each acoustic member are substantially different:

assembling the acoustic members such that the modal distributions of the assembly of acoustic members are interleaved constructively in frequency; and coupling at least one transducer to the assembly to apply bending wave energy to the acoustic members to cause them to resonate to produce an acoustic output.

28. A method according to claim 27, further comprising:

coupling at least two of the acoustic members together such that bending wave energy is transmissible between the acoustic members.

29. A method according to claim 28, further comprising:

coupling the acoustic members together to allow flat-packing of the assembly.

30. A method according to claim 27 or claim 28, further comprising:

making the assembly of acoustic members from a single piece of stiff lightweight sheet material.

31. A method according to claim 30, further comprising:

defining the acoustic members in the single piece of sheet material by forming by at least one groove in the sheet material.

32. A method according to claim 31, further comprising:

forming a parallel pair of grooves between at least two adjacent acoustic members.

33. A method according to claim 32, further comprising: arranging the grooves to enable the sheet material to be folded.

34. A method according to claim 31, further comprising:

arranging the grooves to enable the sheet material to be folded.

35. A method according to claim 31, further comprising:

forming the groove by local compression of the sheet material.

36. A method according to claim 27 further comprising:

selecting as a material for the acoustic members a stiff lightweight sheet material that comprises face skins sandwiching a corrugated core;

arranging the assembly to define a front face having a base and at least one side face; and arranging the corrugated core in the front face so that its corrugations extend perpendicular to the base.

37. A method according to claim 36, wherein the at least one side face has a base, further comprising:

arranging the orientation of the corrugations in at least one side face to be at an acute angle to its base.

38. A method according to claim 27, further comprising:

selecting the parameters of the acoustic members from the group consisting of geometry, size, surface mass density, bending stiffness and internal self damping.

39. A method according to claim 27, further comprising:

selecting the lowest mode of an acoustic member to be below the fundamental resonant frequency of the transducer coupled thereto.

40. A method according to claim 27, further comprising:

providing a plurality of discrete transducers; and selecting the discrete transducers to have different fundamental resonant frequencies.

41. A method according to claim 40, further comprising:

selecting the discrete transducers to have coupler footprints of different size such that their respective aperture resonances are at different frequencies.

42. A method according to claim 27, further comprising:

determining an optimal aspect ratio from calculated modal frequencies of the assembly of panel-form acoustic members.

43. A method according to claim 42, wherein the determining step comprises a cost function analysis based on the central difference of modal frequencies.

* * * * *